US009140004B2

(12) United States Patent
Hansen

(10) Patent No.: US 9,140,004 B2
(45) Date of Patent: Sep. 22, 2015

(54) SOUND CONTROL SYSTEM

(71) Applicant: Paul Hansen, Duluth, MN (US)

(72) Inventor: Paul Hansen, Duluth, MN (US)

(73) Assignee: Paul Hansen, Duluth, MN (US)

( * ) Notice: Subject to any disclaimer, the term of this patent is extended or adjusted under 35 U.S.C. 154(b) by 0 days.

(21) Appl. No.: 14/161,003

(22) Filed: Jan. 22, 2014

(65) Prior Publication Data

US 2014/0202788 A1 Jul. 24, 2014

Related U.S. Application Data

(60) Provisional application No. 61/849,277, filed on Jan. 23, 2013.

(51) Int. Cl.
*E04B 1/86* (2006.01)
*E04B 1/84* (2006.01)

(52) U.S. Cl.
CPC ... *E04B 1/84* (2013.01); *E04B 1/86* (2013.01); *E04B 2001/8461* (2013.01)

(58) Field of Classification Search
CPC ..... E04B 1/86
USPC ..... 181/290, 284; 52/144, 145
See application file for complete search history.

(56) References Cited

U.S. PATENT DOCUMENTS

| | | | | | |
|---|---|---|---|---|---|
| 2,045,733 | A | | 6/1936 | Spafford | |
| 2,104,060 | A | | 1/1938 | Spafford | |
| 3,021,915 | A | * | 2/1962 | Kemp | 181/290 |
| 3,695,395 | A | * | 10/1972 | Ollinger et al. | 181/290 |
| 3,971,867 | A | | 7/1976 | Randall | |
| 4,479,992 | A | | 10/1984 | Haeseker | |
| 4,559,255 | A | | 12/1985 | Shimode | |
| 4,661,392 | A | | 4/1987 | Kapstad | |
| 4,760,677 | A | * | 8/1988 | Nassof | 52/506.1 |
| 4,886,696 | A | * | 12/1989 | Bainbridge | 428/184 |
| 5,202,174 | A | * | 4/1993 | Capaul | 428/138 |
| 5,272,284 | A | * | 12/1993 | Schmanski | 181/210 |
| 5,664,397 | A | * | 9/1997 | Holz | 52/794.1 |
| 5,923,002 | A | | 7/1999 | McGrath | |
| 6,029,770 | A | * | 2/2000 | Schneider et al. | 181/285 |
| 6,821,607 | B2 | * | 11/2004 | Zwick et al. | 428/172 |
| 7,318,498 | B2 | | 1/2008 | Woodman | |
| 7,503,428 | B1 | | 3/2009 | Johnson | |
| 7,721,847 | B2 | | 5/2010 | Coury | |
| 7,779,964 | B2 | * | 8/2010 | Birch et al. | 181/284 |
| 7,789,197 | B2 | | 9/2010 | Duval | |
| 8,495,851 | B2 | | 7/2013 | Surace | |
| 8,512,814 | B2 | | 8/2013 | Bilotto | |
| 2006/0000670 | A1 | * | 1/2006 | Dodd | 181/285 |
| 2013/0161126 | A1 | | 6/2013 | Wilson | |

* cited by examiner

*Primary Examiner* — Forrest M Phillips
(74) *Attorney, Agent, or Firm* — Brett A. Klein

(57) ABSTRACT

A sustainable linear sound-deadening board with a tongue and groove design, which allows multiple boards to connect linearly and giving a both clean and attractive appearance. The board is effective in reducing reverberation within a room as well as acting to improve the soundproofing aspect of undesired sound leaking from one room to another. The board can be made from reused or biodegradable materials thus creating a device that is both cost-effective and less harmful to the environment.

20 Claims, 7 Drawing Sheets

SOUND CONTROL SYSTEM

CROSS-REFERENCE TO RELATED APPLICATIONS

The present application claims priority to U.S. Provisional Patent Application 61/849,277 entitled Sound Deadening Board filed on Jan. 23 2013, the content of which is hereby incorporated by reference herein in its entirety.

FIELD OF THE INVENTION

The present disclosure relates generally to affecting sound within a space by absorbing, controlling, and/or isolating the reflection of sound. More particularly, the present disclosure relates to a sound control system for covering surfaces within a space to control and/or reduce the sound within the space and/or the sound transfer between spaces. Still more particularly, the present disclosure relates to a system of sound deadening boards, which may perform multiple functions, including sound control, sound absorption and/or sound isolation.

BACKGROUND

In an increasingly noisy and close-quarters world, sound diffusion and leakage from room to room or unit to unit is becoming an increasingly pressing issue in terms of enjoyment of peace and quiet in one's abode, place of work, etc. Separately, within a particular room, especially a large room, various surfaces can reflect too much sound, creating a live, reverberant environment, making conversation difficult and making sound quality suffer in general.

To combat these issues, sound tiles, thicker walls and extra layering in construction have been used with varying levels of success. Various technical measurements, such as STC (Sound Transmission Class) can be employed to give a simple representation via a single number such as "54" to represent how much a particular partition in a building prevents noise from reaching the adjacent room. A higher number represents a greater sound dissipation, and the example of 54 would mean that a substantial amount of sound would be blocked, but a significant portion would transmit through the medium. Generally dBA (decibels acoustic) or SPL (sound pressure level) is used to represent the efficacy of various discrete strata within the audible-to-human portion of the sound spectrum.

Sound control devices have long been used in music rooms, such as recording studios and band and orchestra rooms at various educational institutions to combat the issue of unwanted reverberation and noise within a particular room. More recently, these technologies have also seen use in home theater, music rooms and general household living rooms, with the goal of improving sound quality, without necessarily having the goal of preventing sound leakage into the adjacent room or rooms. For devices used to absorb sound, not isolate it, a Sound Absorption Coefficient is generally given, with different ratios from 0.0 to 1.0 for various segments of the audible spectrum, roughly corresponding to ranges like the human voice, to lower ranges, as would befit a home theater with a powerful sub-bass range response. A value of 1.0 being the highest and denoting total sound absorption for a given device, i.e., sound waves that hit the device do not reflect back once they have touched the device.

Typically, however, unless a building is built with the intent of including sound control or isolation, the costs involved in retrofit are prohibitive for most consumers. When a building is built with these features, the walls or floors will generally be thicker, denser or more expensive than a typical house or other building would have. Alternative to initially building the room to control sound is the option of adding tiles, boards or other external insulation to existing structure. Tiles and materials sold have generally been made from highly synthetic materials and have been rather expensive and/or unsightly, especially in terms of inexpensive or home use. Furthermore, the existing external solutions to the problem have been relatively heavy, requiring strong adhesives or fasteners in order to keep the devices attached to the walls, and this can lead to unsightly fasteners being visible externally.

The aesthetic element is especially critical because many currently-offered after-the-fact (after a particular room or building has been constructed and finished) solutions to these sound issues have unusual or unsightly appearances in rooms that often tend to be used for entertaining visitors or other guests who may be surprised to find odd-looking objects affixed to the walls or ceiling, oftentimes at odd angles and colored and textured differently than the rest of the room.

SUMMARY

In one embodiment there is disclosed a sustainable, linear sound deadening board, which can be mounted to interior walls, ceilings, etc. of a room, comprising an outer surface, an inner surface, an upper end, a lower end, a left end, and a right end of the board; an interlocking mechanism allowing the board to interface with other replications of identical boards on either side of the board; a plurality of layers; wherein the layers comprise cellulose or other post-consumer or biodegradable material. A tongue and groove design is utilized in preferred embodiments by offsetting layers below the tongue, allowing one board to couple to other similar boards on either side. Other interlocking mechanisms can also be utilized, such as a finger interlocking mechanism or shipped lapped joints. The board comprises a plurality of layers, generally alternating the directionality of grain at 90-degree rotations or substantially perpendicularly, with such layers composed of cellulose, other sustainable, biodegradable, or re-used material.

In another embodiment, A sustainable sound deadening board is disclosed, comprising a plurality of layers in sandwich-like construction including a bottom layer, an intermediate layer on top of the bottom layer and a top layer on top of the intermediate layer, each layer being of a selectable material particularly adapted to affect sound, wherein the intermediate layer is shifted horizontally relative to the bottom layer creating a tongue and groove affect.

The board has lightweight construction, permitting easy fastening of the board to various surfaces, such as a wall or ceiling in a room of a dwelling, commercial building, or industrial building. Lightweight construction also reduces the cost of manufacturing and solves other problems typically associated with the machining or milling of the interlocking joints. This board also allows more ease in installation by minimizing the cuts required by the installer. The interlocking joint created by offsetting layers integral to the ends of the invention allow for the installer to cut only once at the beginning and end of each row. No back cutting or bevel cuts are required to join each piece.

The board can be covered with various materials, including cloth, paper, vinyl, metal or other material used to finish the surface of the board that is visible from inside the room, thus giving a more attractive appearance to that board. The layers of cellulose, cardboard or other sustainable material can be, for example, corrugated cardboard or similar products. By using such materials on the outside of the board only, a more affordable product is created.

The board's layers of cellulose, cardboard, sustainable material, or synthetic material can be of varying thicknesses and numbers of layers, thus giving the board more widespread and advantageous sound properties. By varying the thickness of each board or set of boards, the product can utilize available retrofit products of common thickness. For example, the board may be applied to an existing wall or ceiling and common extensions may be added to the existing electrical boxes. Likewise, the layers of cellulose or other sustainable material can be of varying densities or arrangements, further enhancing the efficacy of the board.

This board provides a single-product solution to an ongoing problem experienced by many users, both residentially and professionally, of effectively and cost-effectively deadening the sound in a room and sound leaking from a room and purchasing an environmentally friendlier product and customizable product unlike many products currently on the market. The clever design of an example embodiment utilizes a novel approach to linking various boards, while also hiding the fasteners, such as staples or nails, holding the boards to the edges and walls of a room, or other surface, such as a ceiling.

BRIEF DESCRIPTION OF THE DRAWINGS

These as well as other objects and advantages of this sound deadening board will be more completely understood and appreciated by referring to the following more detailed description of embodiments in conjunction with the accompanying drawings of which.

Figure 1:
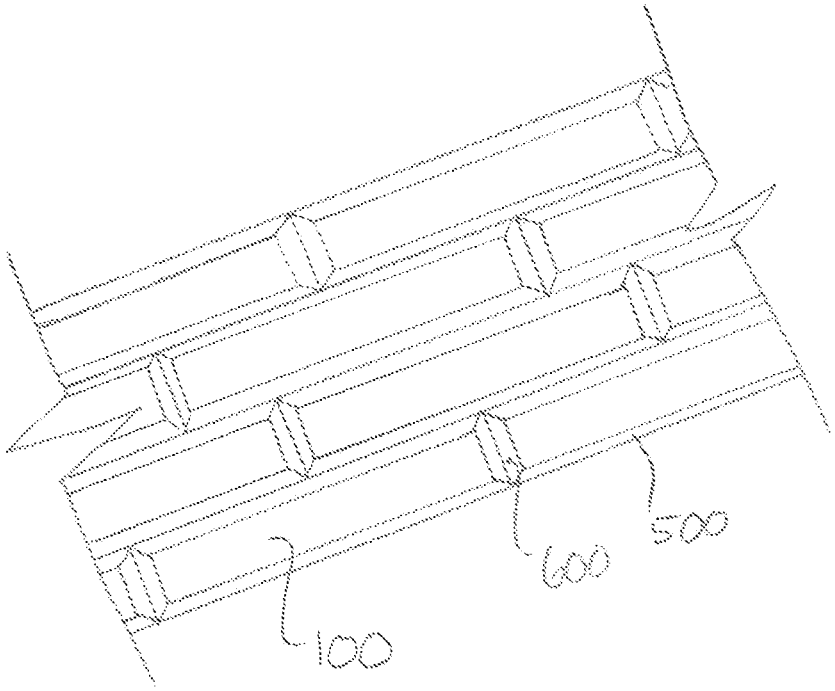
FIG. 1 is a top view of a system of adjacent sound-deadening boards.

Although the subject matter is amenable to various modifications and alternative forms, specifics thereof have been shown by way of example in the drawings and will be described in detail. It should be understood, however, that the intention is not to limit the disclosure to the particular embodiments described. On the contrary, the invention is to cover all modifications, equivalents, and alternatives.

DESCRIPTION

The present disclosure, in some embodiments, relates to a system of sound deadening and/or absorbing boards that may be placed on surfaces such as walls or ceilings within a space to control the sound therein. The boards may be generally elongate boards and when assembled into a system may provide a pleasantly aesthetic system with a series of parallel extending elongate elements. This may be in contrast to other known sound control systems that are more patchy and aesthetically obtrusive. The boards may be of layered construction allowing the overall effect on sound to be customizable based on the selection of the material used in the several layers. In addition, the assembly of the boards into a system may allow them to interlock to form a larger array of boards having a unified appearance and allowing for large expansive systems to be installed, while avoiding warpage or other out-of-plane distortion.

Referring now to FIG. 1, a sound control system is shown. The system may include an assembly of sound control elements such as sound deadening boards. The sound control elements may be arranged in a generally rectangular-like array where the several elements are extending generally parallel to one another and are placed end-to-end as well as adjacent to other elements in the array. The end-to-end placement and adjacent placement may include an interlocking or other substantially tight fit allowing for the assembly to appear as a unified or at least assembled series of elements. The system may be sized, shaped, placed, and oriented on a surface and configured to affect the sound within the space. It is to be appreciated that considerations may be given to aesthetics, durability, finish, and other factors when considering how to select the size, shape, placement, and orientation of the system.

In one example, the sound control system can be used in an educational band room where the system is configured to control sound created from a variety of instruments at unpredictable volume levels. In the same example, the system may be configured to isolate and absorb as much sound as possible to prevent noise leakage and diffusion to other unwanted quarters. In another example, the sound control system may be used in a home or commercial theater setting where volume levels are generally more predictable. In the theater system example, preventing sound leakage into the adjacent room or rooms may or may not a primary goal of the sound control system. However, the sound control system may be configured and designed for improving the sound output quality for audiences.

In some embodiments, the system may be used to cover all or substantially all of a wall or ceiling. In other embodiments, a lesser portion of the wall or ceiling may be covered and one or more panels of the system may be used to affect the sound in the space. The elongate nature of the system may allow for plank-like, or slat-like sections of the system to be installed to affect aesthetics together with sound. In other embodiments, other geometrical shapes may be included. In some embodiments, a rectangular or angled orientation of a panel may be used. In other embodiments, the panel or panels may be in a parallel plane adjacent a wall or ceiling or the panel may be tipped relative to the wall and out of plane with the wall. The panels may be placed high or low or at intermediate heights of a wall or along the sides or middle of a ceiling structure. Still other sizes, shapes, locations, and orientations may be used.

As shown, in some embodiments, the system may include an assembly of sound control elements where a large portion of the elements are substantially the same or even identical. In some embodiments, all of the elements in a system may be substantially the same and in other embodiments, all of the elements in a system may be substantially the same except for end or edge elements that may be cut to fit or to affect the size or shape of the system. Given the similar nature of the several elements used to make up the system, the remaining portion of the specification may focus on a particular element of the system.

Figure 2:
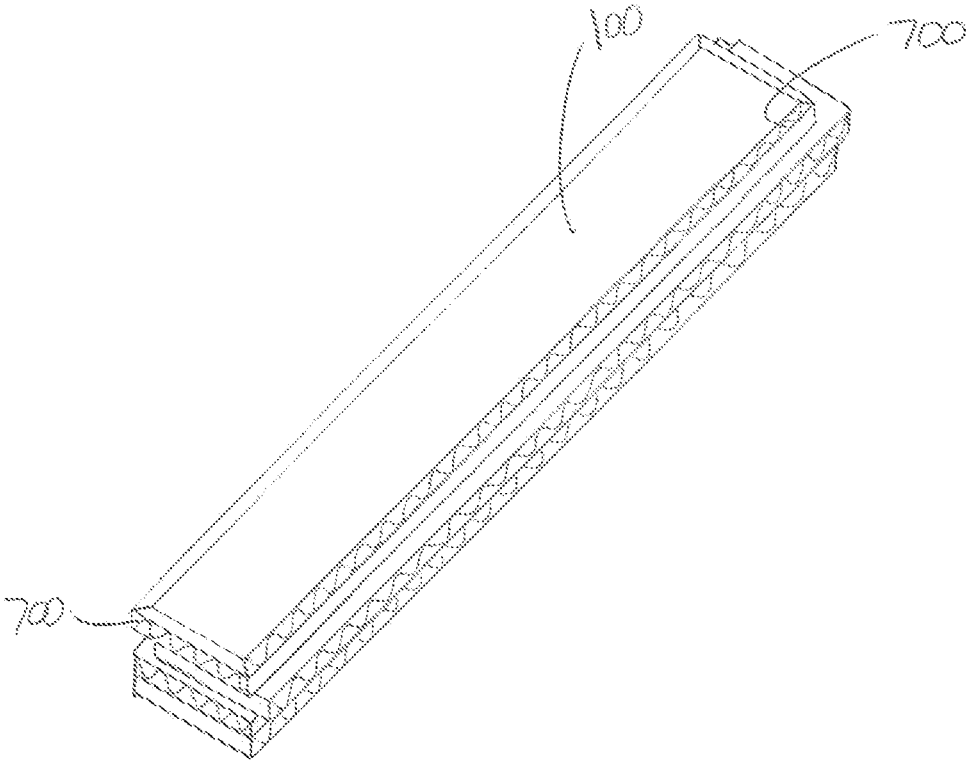
FIG. 2 is a top perspective view of a layered sound-deadening board of the system of FIG. 1.

As shown in FIG. 2, a perspective view of a sound control element is shown. The sound control element may include a plurality of layers including a bottom layer, an intermediate layer, a top layer, and a finish layer. The plurality of layers of the sound control system may be constructed from materials of varying source, density and thickness. The sound control element may be configured to affect sound when sound waves are imparted thereon. Moreover, the element may be configured to be assembled in a sound control system such as the ones described above. The particular layers may be selected to affect sound in a particular way and some of the layers may be different than other layers or all of the layers may be the same or similar material. In some embodiments, some layers may be adapted to allow sound through in one direction, but resistant to allowing sound travel the opposite direction when some sound waves are reflected back in the direction of the source. Lower layers may be sound absorbing layers, for example. Still other arrangements of layers may be provided.

Each sound-deadening board is assembled to sit on top of, below, or on the side of a same or similar sound-deadening board. By using boards that are roughly the same depth, a linear effect is created when a series of elongated boards of similar material are assembled together. The linear effect of the board is also exemplified when the adjacent boards connect as so to not expose any part of the wall or mounting base.

Figure 3:
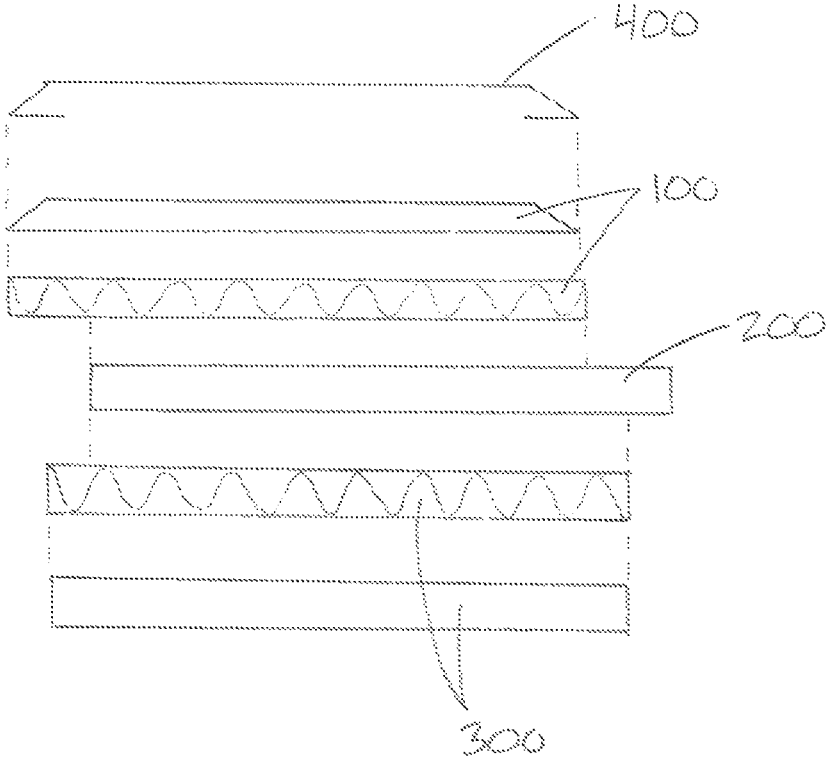
FIG. 3 is an exploded cross-sectional view of a sound-deadening board of the system of FIG. 1.

As shown in FIG. 3, an outermost layer 400 may be provided and may wrap around the outside of a single-sound deadening board, which can be selected from a cloth, paper, vinyl, metal or other material. The covering portion may be selected to address issues of aesthetics, sound, and other factors. The covering portion may be arranged relatively taut across the backing or top layer and may be secured to the backing or top layer with adhesive. In some embodiments, the covering portion may be secured to an underside of the top or backing layer with adhesive, staples, or other securing systems. Still other securing systems or devices may be used.

In addition, a top horizontal or backing layer 100 may be included as one of the three horizontal layers that comprise the sound-deadening board. Any given layer of the sound control system may be constructed of multiple plies. For example, referring now to FIG. 3, a top horizontal layer 100 and a bottom horizontal layer 300 are both comprised of double ply layers. The top layer 100 may be positioned to sit above a middle horizontal layer 200 in each sound-deadening board. The top horizontal layer 100 of each sound-deadening board may be the layer that becomes exposed on the mounting surface. The top layer 100 may include a portion with flutes extending in the long direction in addition to a portion with flutes extending in the short direction. Thus, it may be desirable to wrap this top horizontal layer 100 with a covering portion 400 both to create a good aesthetic, but also close off areas where the flutes may be exposed as shown in FIG. 2.

The top or backing layer 100 may include chamfered edges 500, extending along the length of the layer and may also include chamfered edges on the ends of the layer 600. The top view of the system as shown in FIG. 1 reflects a pleasant aesthetic due to the chamfered edges 500, 600. In other embodiments, the chamfer may be omitted and a more rectangular profile may be provided.

As shown in FIG. 2, the top horizontal layer 100 also includes a portion with flutes extending along the length of the board 700 and along the width of the board 700. Any given layer may be made up of one or more sub-layers of material with same or differing grain orientations from other surrounding layers of the sound control system. Differing grain orientations allow for an elongated assembly of the boards because the varying grain (i.e., the flutes) allow the particular layer to resist bending or warpage in multiple directions.

Referring now to FIG. 3, a middle horizontal layer 200 may be oriented to sit between the top horizontal layer 100 and a bottom horizontal layer 300. The middle horizontal layer 200 may be offset horizontally from the top layer 100 and the bottom horizontal layer 300. This offsetting of layers may create a tongue and groove effect. The tongue and groove effect may allow for a continuous network of the sound-deadening boards, allowing them to interlock with each other in a seamless fashion. The bottom horizontal layer 300 may be oriented to sit adjacent to the mounting base or wall that the sound deadening board is fixated or secured to.

Figure 4:
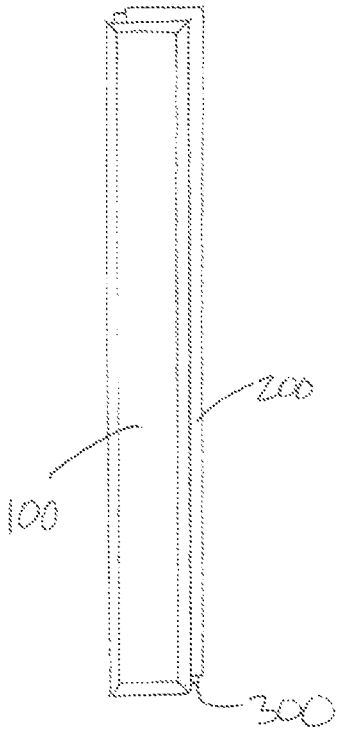
FIG. 4 is a top view of a sound-deadening board of the system of FIG. 1 showing a top board and a bottom board that are not vertically aligned.
Figure 5:
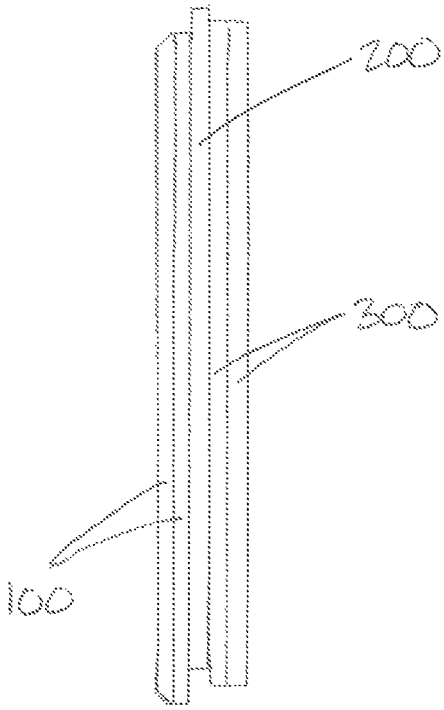
FIG. 5 is a side view of a sound-deadening board of the system of FIG. 1 showing a top board and a bottom board that are not vertically aligned.
Figure 6A:
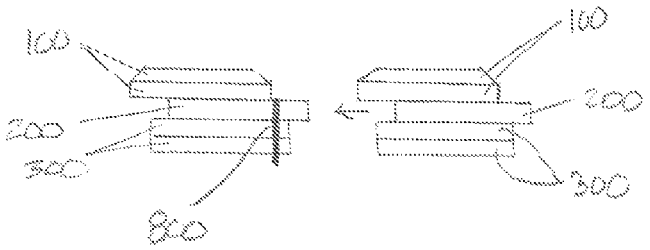
FIG. 6A is a side view of two adjacent sound deadening boards of the system of FIG. 1 showing a top board and a bottom board that are not vertically aligned.
Figure 6B:
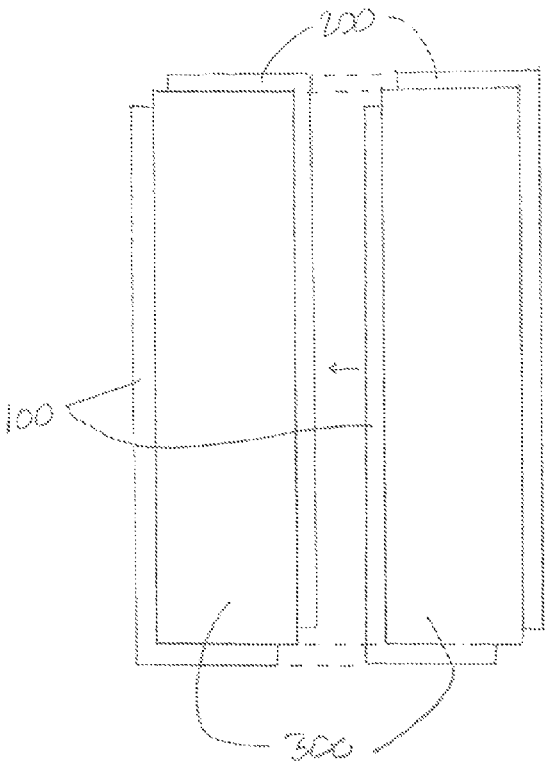
FIG. 6B is a bottom view of a sound-deadening board of the system of FIG. 1 showing a top board and a bottom board that are not vertically aligned.
Figure 7:
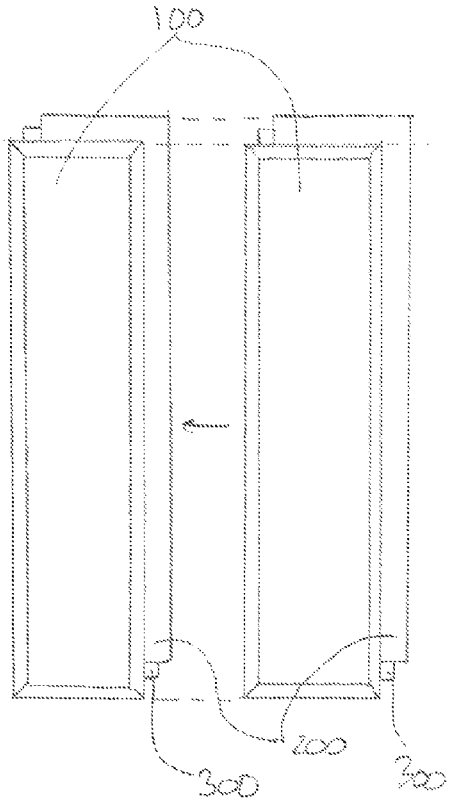
FIG. 7 is a top view of a sound-deadening board of the system of FIG. 1 showing a top board and a bottom board that are not vertically aligned.

Referring now to FIGS. 4 and 5, in one embodiment, the top horizontal layer 100 and the bottom horizontal layer 300 may not be vertically aligned with each other in one or more directions. In this embodiment, on the tongue side/end of the board the bottom horizontal layer 300 may extend more horizontally outward than the top horizontal layer 100 to help support a relatively flexible tongue. This embodiment may be useful for sound deadening board arrangements wherein the middle horizontal layer 200 is made from a more flexible material. The extension of the bottom horizontal layer 300 thus acts as a support to the middle horizontal layer 200 by supporting a portion of the length that extends outward from the middle horizontal layer 200. Where the tongue portion of the board is used for placement of a fastener, the extending bottom layer 300 may support the inner portion of the tongue during placement of fasteners through this inner portion of the tongue.

In one embodiment, a fastener 800 is inserted through a tongue on a middle horizontal layer 200 at an angle near the base of the tongue before another board is placed adjacent to this board. An opposite side of the adjacent piece, which may be a tongue from a middle horizontal layer, is fastened by repeating this fastening approach. This process pins the adjacent board to the first board. The ability of the board to hide a fastening device 800 in an adjacent board, paired with the covering material 400 of the boards, leads to an aesthetically pleasing appearance of the boards, belying the true, logical and inexpensive nature of the underlying apparatus and board.

The array of horizontal layers allows customizability of the sound deadening board. Each layer of the system can be made from the same or different material, allowing users to construct their system from a mix of cellulose or other post-consumer or biodegradable material. The ability of each layer to be made from different material also allows a variety of combinations of different layers to be used for specific, particular purposes. For example, referring to FIG. 8, in one embodiment, the top horizontal layer 100 may be constructed from different material than the bottom horizontal layer 300. In another embodiment, all three horizontal layers may be made from the same post-consumer, biodegradable or synthetic material but the wrap material 400 may be a different material than the horizontal layers.

The tongue and groove aspect of the board is just one example of an interlocking mechanism that may be used to connect adjacent boards. In one embodiment, multiple tongues protrude from a single board and are able to interlock with adjacent grooves. In another embodiment, a ship lapped or finger interlocking mechanism may be utilized to interlock adjacent boards.

Figure 8:
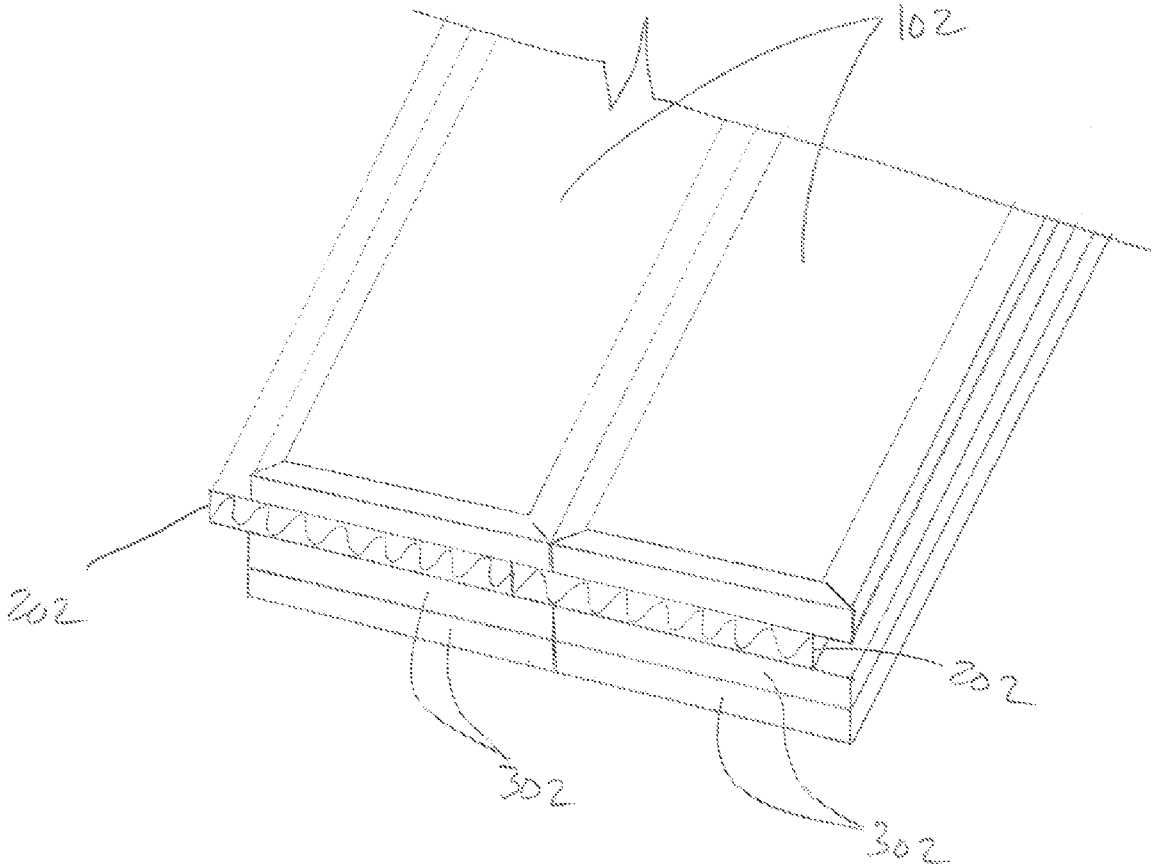
FIG. 8 is a perspective view of two adjacent sound deadening boards.

Referring now to FIG. 8, two replications of an embodiment of the device is shown. In this embodiment, the top horizontal layer 102 is vertically aligned with the bottom horizontal layer 302 of the embodiment. In this embodiment, the bottom horizontal layer 302 does not extend to support the tongue of the embodiment which, in this example, is the middle horizontal layer 202. In this embodiment, the tongue of the interlock system may be made from a stronger material that is able to support itself during the interlocking process because of the lack of support from an unextended bottom horizontal layer 302.

Figure 9:
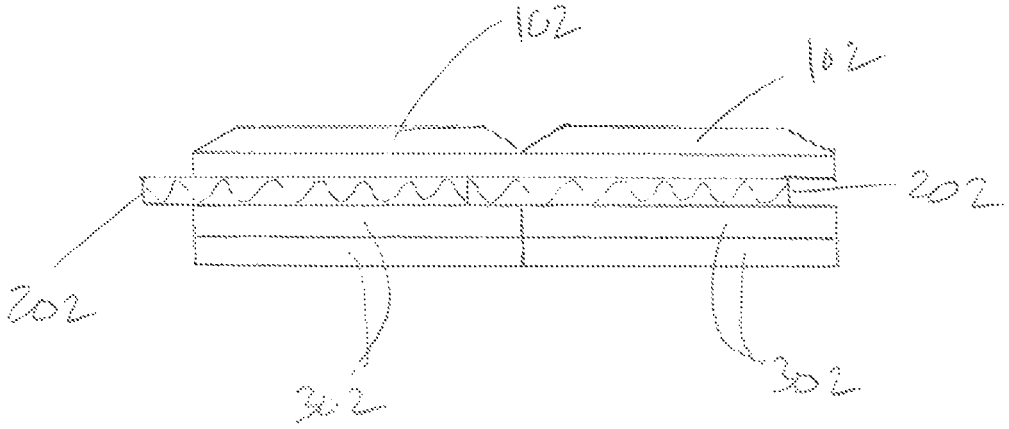
FIG. 9 is a side view of two adjacent sound deadening boards.

Referring now to FIG. 9, a side view of two adjacent sound-deadening boards is shown. In yet another embodiment, a middle horizontal layer 202, acting as a tongue in an interlocking mechanism, may not be supported by a bottom horizontal layer 302. In this embodiment, the top horizontal layer 102 is vertically aligned with a bottom horizontal layer 302.

Persons of ordinary skill in the relevant arts will recognize that the subject matter may comprise fewer features than illustrated in any individual embodiment described above. The embodiments described herein are not meant to be an exhaustive presentation of the ways in which the various features of the subject matter may be combined. Accordingly, the embodiments are not mutually exclusive combinations of features; rather, the subject matter may comprise a combination of different individual features selected from different individual embodiments, as understood by persons of ordinary skill in the art, and are within the scope of the following claims.

What is claimed is:

1. A system for creating a sound control panel, comprising:

a plurality of layerable materials, each of the plurality of layerable materials being selectable and assemblable based on particular design factors comprising structural integrity, acoustics, durability, finish, and aesthetics;

a plurality of layers comprising at least a first layer, a second layer, and a third layer;

the first layer selected from the plurality of layerable materials, the selection being based on at least a first design factor;

the second layer selected from the plurality of layerable materials and arranged immediately adjacent to the first layer, the selection of the second layer being based on at least a second design factor different from the first design factor;

the third layer selected from the plurality of layerable materials and arranged immediate adjacent the second layer, the selection of the second layer being based on at least a third design factor different from the first design factor and the second design factor; and wherein the plurality of layers form an assembly mechanism configured for assembling a continuous network of panels that addresses the particular design factors as a whole.

2. The system of claim 1, wherein the first design factor is structural integrity and the first layer and second layer are selected to have a varying orientation of flutes to resist bending, distortion, or warping.

3. The system of claim 1, wherein the second design factor is acoustics and the third layer is selected to include a material that affects absorption, reflection, or diffusion of energy.

4. The system of claim 1, wherein the interlocking mechanism comprises at least one tongue and at least one groove, the at least one tongue and at least one groove created by offsetting an intermediate layer of the plurality of layers.

5. The system of claim 1, wherein each of the materials are selected and varied according to one or more performance qualities, the performance qualities comprising at least one or more of: source, thickness, density, absorbability, reflectivity, isolation, diffusion, and leakage;

wherein the performance qualities, in combination with a number of the layers and the design factors, are selectable to redistribute the energy associated with sound.

6. The system of claim 1, wherein the interlocking mechanism is configured to connect the panel with one or more additional panels, the interlocking mechanism comprising one or more tongues arranged along both a first side and a second side of the panel and one or more grooves arranged along a third side and a fourth side of the panel, wherein the third side and fourth side share a common corner and are different from the first side and the second side; and wherein the one or more tongues extend outward from at least one intermediate layer.

7. The system of claim 1, wherein the plurality of layers comprises differing grain orientations, the orientations comprising opposing flutes or aligning flutes to create a desired structural result.

8. The system of claim 1, wherein the interlocking mechanism comprises numerous projected regions on each side of the panel that interlock with adjacent and fitted slots in neighboring panels to create a finger interlocking effect.

9. The system of claim 1, wherein the interlocking mechanism comprises a ship lapped interlocking mechanism.

10. The system of claim 4, wherein the plurality of layers comprise a top layer and a bottom layer, the bottom layer and the top layer being vertically unaligned such that the bottom layer extends more outward beyond the top layer and the bottom layer is configured to support the at least one tongue.

11. The system of claim 1, wherein the plurality of layers are configured to conceal staples or fastening devices used for installation.

12. The system of claim 1, further comprising a cover, the cover having a finish material and configured to be affixed to a top layer or a backing portion of the panel with one or more of a securing system.

13. The system of claim 1, wherein the plurality of layers are configured to be cut with a utility knife.

14. A system comprising:

a sound control panel comprising:

a plurality of layers comprising at least one intermediate layer sandwiched between a top layer and a bottom layer, the plurality of layers comprising one or more materials;

an interlocking mechanism configured to connect with one or more additional panels, the interlocking mechanism comprising one or more tongues arranged along two adjacent sides of the panel and one or more grooves arranged along another two sides of the panel, the another two sides of the panel being different from the two adjacent sides of the panel;

wherein the one or more tongues extend outward from the at least one intermediate layer and the connection of the one or more tongues with the one or more grooves creates a continuous network of multiple panels; and wherein the one or more tongues and grooves are created by offsetting at least one layer.

15. The system of claim 14, wherein the bottom layer and the top layer are vertically unaligned, the bottom layer extending outward beyond the top layer and configured to support the one or more tongues.

16. The system of claim 14, wherein each of the materials are selected and varied according to one or more performance qualities, the performance qualities comprising at least one or more of: source, thickness, density, absorbability, reflectivity, isolation, diffusion, and leakage;

wherein the performance qualities, in combination with a number of the layers and the design factors, are selectable to redistribute the energy associated with sound.

17. The system of claim 14, wherein the plurality of layers comprises one or more sub-layers, the one or more sub-layers comprising one or more materials.

18. The system of claim 14, further comprising a fastener inserted through a tongue on a middle horizontal layer of the panel at an angle near a base of the tongue and the fastener is inserted before another panel is placed adjacent to the panel.

19. The system of claim 14, wherein the plurality of layers are selectable and assemblable based on particular design factors comprising structural integrity, acoustics, durability, finish, and aesthetics.

20. The system of claim 14, wherein the panel or network of multiple panels comprise a rectangular shape or a geometric shape; and wherein the panel is configured to be cut down to a size or shape.

* * * * *